United States Patent [19]

Horiuchi et al.

[11] Patent Number: 4,759,632

[45] Date of Patent: Jul. 26, 1988

[54] METHOD AND APPARATUS FOR PRODUCING A SLURRY FOR UNDERWATER PLACEMENT

[75] Inventors: Sumio Horiuchi, Tokyo; Katsuyuki Tamaoki, Kawasaki; Atsuo Onoue, Narashino; Shigeru Goto; Toru Kawai, both of Chiba, all of Japan

[73] Assignee: Shimizu Construction Co., Ltd., Tokyo, Japan

[21] Appl. No.: 833,361

[22] Filed: Feb. 25, 1986

[30] Foreign Application Priority Data

Mar. 1, 1985 [JP] Japan ..... 60-40539
Aug. 27, 1985 [JP] Japan ..... 60-188252

[51] Int. Cl.[4] ..... B28C 5/08; B28C 7/16; B01F 11/00

[52] U.S. Cl. ..... 366/2; 366/51; 366/118

[58] Field of Search ..... 366/2, 6, 8, 14, 15, 366/27, 51, 65, 66, 50, 108, 137, 113, 118, 136, 28, 29; 55/15, 52, 277; 106/DIG. 1; 405/222, 223

[56] References Cited

U.S. PATENT DOCUMENTS 2,093,586 9/1937 Day ..... 366/65 X
2,185,540 1/1940 Cady ..... 366/118
4,117,547 9/1978 Mathis et al. ..... 366/50 X
4,374,672 2/1983 Funston et al. ..... 106/DIG. 1 X
4,397,587 8/1983 Opden Velde et al. ..... 405/222
4,403,863 9/1983 Fukushima et al. ..... 366/8
4,408,889 10/1983 Peschl ..... 366/113
4,431,310 2/1984 Ito et al. ..... 366/8
4,436,429 3/1984 Strong et al. ..... 366/2
4,618,376 10/1986 Saternus et al. ..... 366/2 X

*Primary Examiner*—Harvey C. Hornsby
*Assistant Examiner*—Scott J. Haugland
*Attorney, Agent, or Firm*—Scully, Scott, Murphy & Presser

[57] ABSTRACT

A method and apparatus for producing a slurry for underwater placement. The slurry is prepared by a mixer and the mixed slurry is then agitated by an agitator. Before underwater placement of the slurry, bubbles in the slurry is reduced. The apparatus includes a supplying device for supplying a hydraulic material and water in a predetermined ratio; a mixing device for mixing the hydraulic material and the water supplied from the supplying device to produce a slurry; an agitating device for receiving the slurry from the mixing device and for agitating the slurry; and a deaerating device for receiving the agitated slurry from the agitating device and for deaerating the agitated slurry.

9 Claims, 4 Drawing Sheets

METHOD AND APPARATUS FOR PRODUCING A SLURRY FOR UNDERWATER PLACEMENT

BACKGROUND OF THE INVENTION

The present invention relates to a method and apparatus for producing a slurry, such as a fly ash slurry, mortar, grout and concrete, for use in underwater placement, for example, for the purpose of reclaiming land from sea and lakes.

One of the inventors has proposed as a joint inventor a method for placing a fly ash slurry underwater in Japanese Patent Application No. 57-21836 filed on Feb. 13, 1982. In this prior art method, fly ash and water are mixed by a mixer and then agitated by an agitator to produce a fly ash slurry, which is then fed by means of a pump to a placing pipe of which discharge end is located near the bottom of sea or a lake. The slurry is discharged from the discharge end which is kept within the slurry placed.

However, this method has a drawback in that during underwater placement, a part of the fly ash in the slurry is dispersed in the water as suspended solids because light particles such as cenosphere are involved in the fly ash. The fly ash exhibits high pH in water and hence water near the placed fly ash slurry rather increases in pH and concentration of the suspended solids, resulting in water pollution. The inventors have noted that this is caused by phenomena that during production of the fly ash slurry, particularly during agitation thereof with an agitator, a great number of fine bubbles are formed in the slurry, and that the bubbles are gathered during pumping up to the underwater placement site, where large bubbles are evolved and thereby part of the slurry is scattered in the water, so that a great amount of fly ash in the scattered slurry suspends in the water. This was also noted in underwater placement of a mortar, grout and concrete.

SUMMARY OF THE INVENTION

Accordingly, it is an object of the present invention to provide a method and apparatus for producing an underwater placement slurry, which method and apparatus prevent the slurry from scattering due to bubbles in the slurry in water to thereby prevent pH and concentration of suspended solids in the water from increasing.

With this and other objects in view, one aspect of the invention is directed to a method of producing a slurry for underwater placement, in which the slurry is prepared by a mixer and the mixed slurry is then agitated by an agitator. Before underwater placement of the slurry, bubbles in the slurry is reduced.

The other aspect of the present invention is directed to an apparatus for producing a slurry for underwater placement. The apparatus includes a supplying device for supplying a hydraulic material and water in a predetermined ratio; a mixing device for mixing the hydraulic material and the water supplied from the supplying device to produce a slurry; an agitating device for receiving the slurry from the mixing device and for agitating the the slurry; and a deaerating device for receiving the agitated slurry from the agitating device and for deaerating the agitated slurry.

DETAILED DESCRIPTION OF THE DRAWINGS

DETAILED DESCRIPTION OF THE PREFERRED EMBODIMENTS

Figure 1:
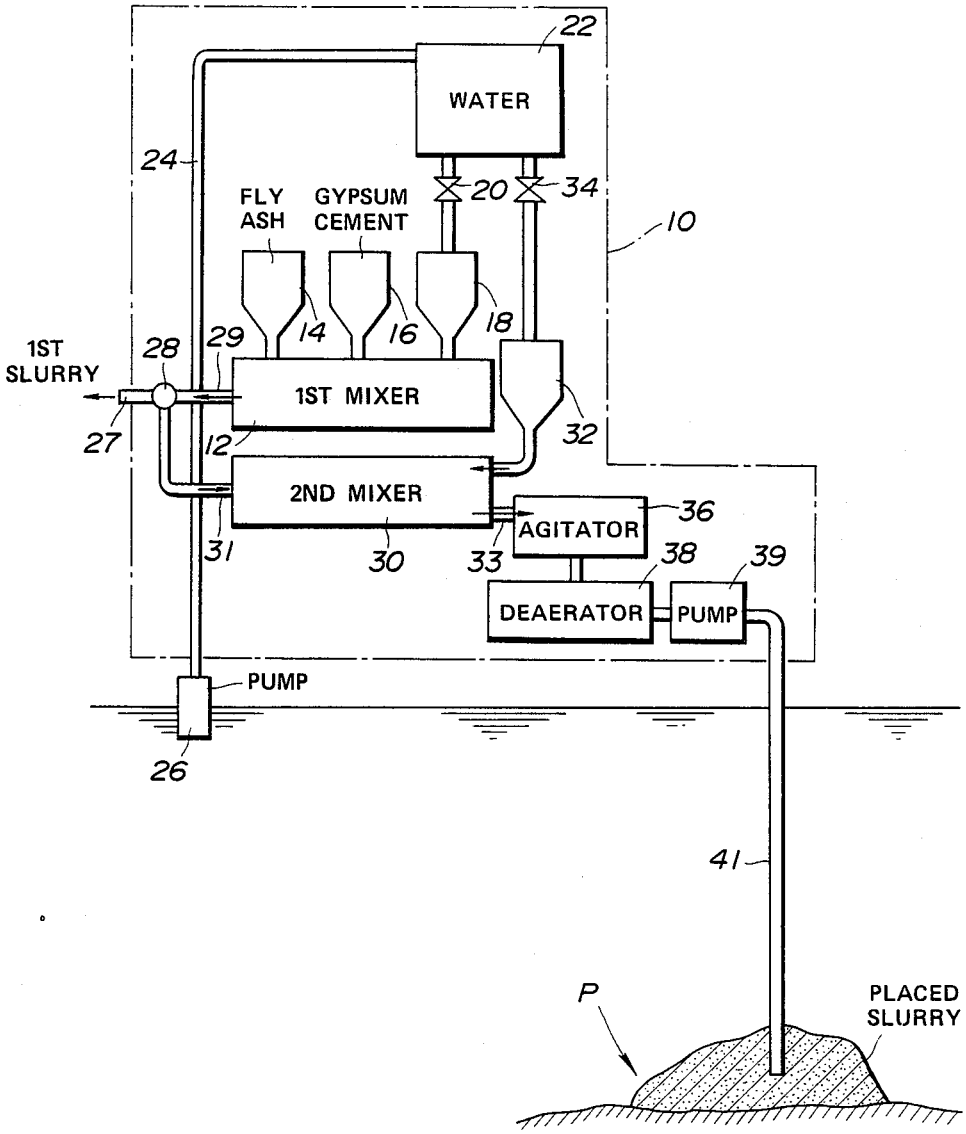
FIG. 1 is a flow chart of a fly ash slurry producing apparatus according to the present invention.

Referring to FIG. 1, reference numeral 10 designates a fly ash slurry producing apparatus according to the present invention. The apparatus 10 is located on shore and includes a first screw mixer 12 for mixing a fly ash with water to produce a first slurry where a small amount of gypsum and cement may be added if necessary. The first mixer 12 is communicated to a fly ash measuring tank 14, hydraulic setting material measuring tank 16 and a first water measuring tank 18. The first water measuring tank 18 is connected via valve 20 to a water tank 22 which is supplied with water from sea or a lake near a placement site by means of a pipe 24 and a pump 26. The hydraulic setting material measuring tank 16 is supplied with a portland cement and gypsum from respective supply sources not shown. The first mixer 12 is communicated at its outlet port 29 via a change-over valve 28 to an inlet port 31 of a second screw mixer 30 for mixing the first slurry with additional water to produce a second slurry. The first mixer 12 is also connected via the valve 28 to a transport pipe 27 for supplying the first slurry or wet fly ash for land use. The second mixer 30 is supplied with the additional water from a second water measuring tank 32, which is in turn supplied with the additional water from the water tank 22 via a valve 34. The outlet port 33 of the second mixer 30 is connected to an agitator 36 for agitating the second slurry.

Figure 2:
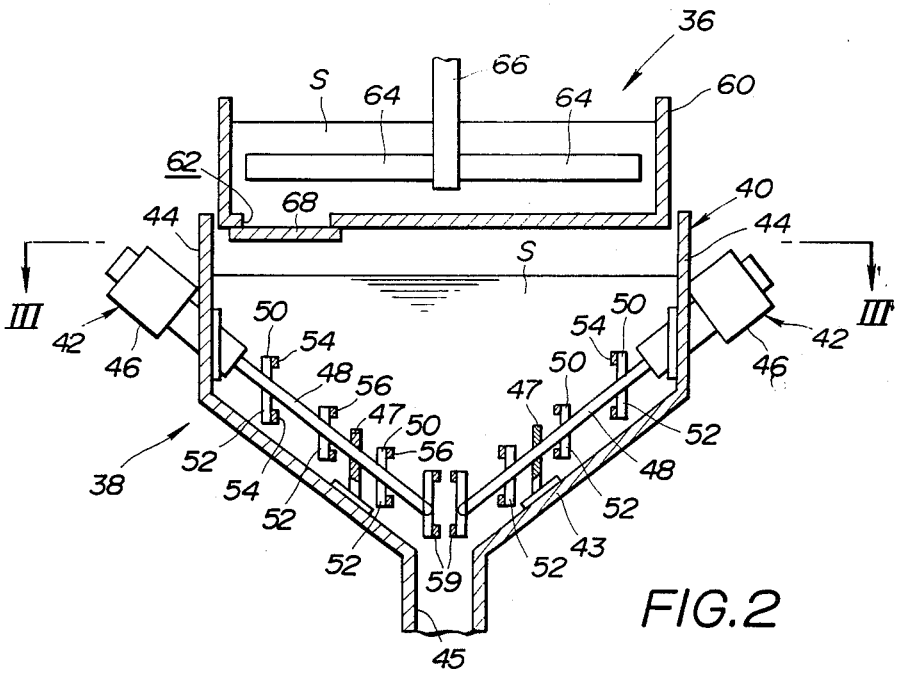
FIG. 2 is an enlarged axial section of the agitator and the deaerator in FIG. 1.

As illustrated in FIG. 2, the agitator 36 includes a tank 60, having an exhaust opening 62 at its bottom, and agitating blades 64 mounted on a vertical rotation shaft 66 to be received within the tank 60. The tank 60 has a slidable closure plate 68 mounted on its bottom to close the discharge opening 62, the slidable closure plate 68 being horizontally moved by a solenoid not shown.

Provided below the agitator 36 is a deaerator 38 for removing or at least reducing fine bubbles in the second slurry S. The deaerator 38 includes a funnel-shaped tank 40 and four vibrating devices 42 mounted on the flange wall 44 of the tank 40. Each vibrating device 42 has a concrete vibrator 46 and a vibrating rod 48 mounted at its one end to the vibrator 46 to extend toward the axis of the tank 40 along the bottom thereof. Each of the vibrating rods 48 is provided at predetermined intervals with four pairs of vertical upper and lower branches 50 and 52. Four pairs of vibration rings 54, 54; 56, 56; 58, 58; and 59, 59 are integrally attached to distal ends of corresponding branches 50 and 52 to be concentric with the axis of the tank 40. The vibrating rods 48, branches 50 and 52 and the vibrating rings 54, 56, 58 and 59 are made of stainless steel and serve to efficiently transfer vibration from the vibrator 46 to the slurry S. Each vibration rod 48 passes through and is thereby supported by a supporting leg 47 which is vertically mounted on the inner face of a funnel portion 43 of the tank 40. The supporting legs 47 also serve to transmit vibration from the vibrator to relatively high viscosity slurry S which is near the outlet 45 of the tank 40 and is less easy to be discharged through the outlet 45. The deaerator 38 efficiently reduce the foam in the slurry S within the tank 40 by actuating the vibrators 46. The deaerator 38 may be provided downstream of the second mixer 30 and when it is disposed just after the agitator 36, the most excellent effect in removing the foam in the slurry S is achieved since the slurry S near the agitator 36 has relatively low viscosity.

The deaerator 38 is connected at its discharge port 45 via a valve not shown to a pump 39, from which a placing pipe 41 extends into the water to the site to be reclaimed.

The fly ash used in the present invention includes, for example, coal ashes produced from coal power plants and other coal combustion plants and is not limited in kind and nature. The fly ash supplied from the supply source is measured by the fly ash measuring tank 14 and then introduced in a predetermined amount into the first mixer 12.

Water is added from the water measuring tank 18 in a predetermined amount into the first mixer 12 for producing the first slurry. The water is added for a specific fly ash within a range of an optimum water content thereof ± about 10% or from the optimum water content—about 10% to the optimum water content + about 10%, preferably at about the optimum water content. The optimum water content is determined according to a compaction test ASTM D698-78, "Standard Test Methods for Moisture-Density Relations of Soils and Soil-Aggregate Mixtures using 5.5-lb Rammer and 12-in. Drop". The optimum water content generally ranges from about 15 to about 30% by weight although it depends on the sort of fly ash. The water content is defined as (water weight/fly ash weight) × 100%. In the present invention, sea water, lake water and rain water may be used as the water for the slurry other than clean water, such as tap water and well water.

For producing a high density and low viscosity slurry, a surface active agent, such as salt of lignin sulfonic acid and salt of hydroxy acid, may be added to the water, thus enabling a larger amount of fly ash to be mixed in a given volume of slurry. The surface active agent may be added in an amount of about 0.05–0.3 weight parts, preferably about 0.1–0.2 weight parts, per 100 weight parts of fly ash.

A kind of fly ash is poor in self-hardening property and its slurry exhibits insufficient compressive strength when it is set. To such fly ash, a hydraulic material, such as a portland cement, and a hardening additive such as gypsum may be added for enhancing compressive strength of the reclaimed site. For providing sufficient strength to the hardened slurry, cement may be added up to in an amount of about 5 weight parts per 100 weight parts of the fly ash. Calcium hardening material, such as calcium oxide and granulated slug, can exhibit the same effect as cement.

Gypsum, including anhydrous gypsum, hemihydrate gypsum, and dihydrate gypsum, may be added up to about 50 weight parts, preferably about 2–10 weight parts, per 100 weight parts of the fly ash. Combination of cement with gypsum provides excellent results. A large increase in strength of the hardened second slurry is achieved when cement and gypsum are used in a ratio of about 1:2.

Aggregates such as sand, gravel and bottom ash may be added to the slurry without deteriorating fluidity of the slurry. Such aggregates slightly decrease strength of the hardened slurry.

The first slurry thus prepared is introduced via the change-over valve 28 into the second mixer 30 where it is mixed with additional water from the water measuring tank 32 to produce the second slurry. According to the present invenion, the additional water is generally added in a water content of about 5–25% by weight. The second slurry produced with such an additional water content has high fluidity suitable for underwater placing.

Then, the second slurry is fed to the agitator 36 to keep it at a predetermined viscosity and then introduced into the deaerator 38 where the second slurry is deaerated to thereby appropriately reduce fine bubbles in it. The slurry deaerated is delivered by the pump 39 via the placing pipe 41 to the placement site P where it is sedimented on the sea bottom or the lake bottom.

When the placement of the slurry is discontinued and when there is a need for supplying the first slurry or wet fly ash for land use, the change valve 28 may be actuated for feeding the first slurry to the transport pipe 27 from which the wet fly ash is supplied. For the purpose of supplying the wet fly ash during placement of the second slurry, the change-over valve 28 may be replaced by a conventional flow control valve which controls flow rates of the first slurry in the transport pipe 27 and inlet port 31.

The deaeration process according to present invention may be applied to a slurry including a hydraulic material such as grout, mortar and concrete for underwater placement.

Figure 3:
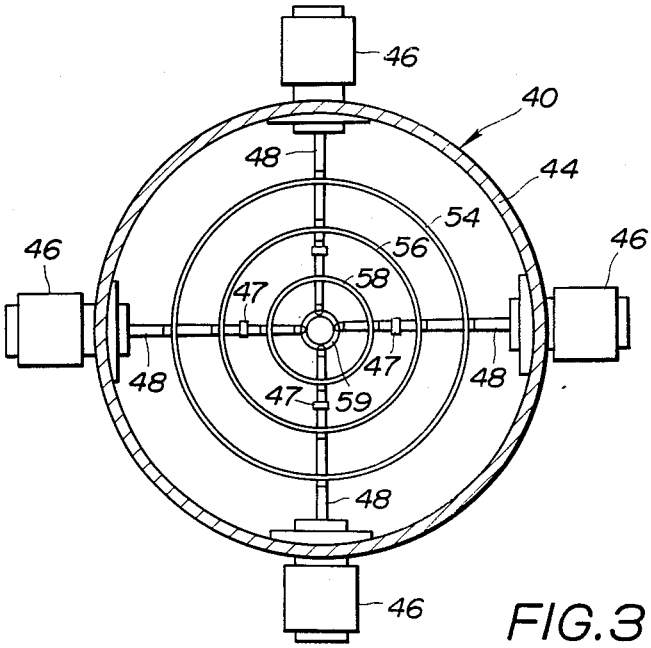
FIG. 3 is a view taken along the line III—III in FIG. 2.
Figure 4:
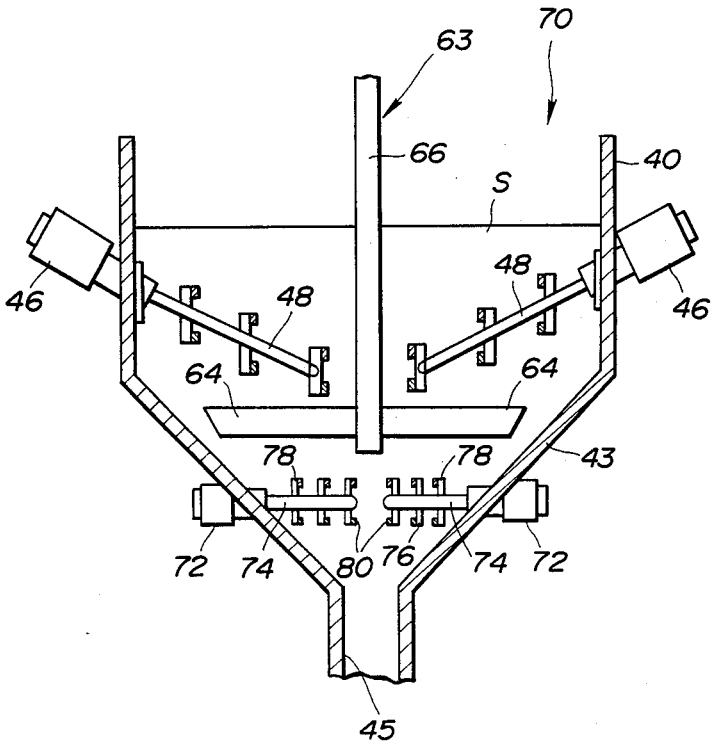
FIG. 4 is a modified form of the deaerator in FIG. 2.

A modified form of the deaerator 38 in FIGS. 2 and 3 is illustrated in FIG. 4 in which like reference numerals designate parts corresponding to parts of the embodiment in FIGS. 2 and 3 and explanations thereof are omitted. This modified deaerator 70 is distinct from the deaerator 38 in FIGS. 2 and 3 in that four sub-vibrators 72 (only two of which are shown) are sealingly mounted to the funnel portion 43 of the deaerator 70 so that the vibration rods 74 horizontally extend toward the axis thereof, and in that an agitator 63 is provided within the tank 40 of the deaerator 70, its agitator shaft 66 extending along the axis of the tank 40 of the deaerator 70 so that agitating blades 64 are disposed between the vibration rods 48 of the main vibrators 46 and the vibration rods 74 of the sub-vibrators 72.

The sub-vibrators 72 are used for improving deaeration of the second slurry S and for enhancing fluidity of the second slurry S so that it is easily discharged from the discharge port 45 of the deaerator 70. Each of the sub-vibrators 72 is provided at its vibration rod 74 with three pairs of vertical branches 76 and 78 to which are attached corresponding concentric vibration rings 80 as in the main vibrators 46.

The agitator 63 serves to facilitate deaeration of the second slurry S and also achieves uniform mixing thereof by disposing agitating blades 64 between the vibrators 46 and 72.

Following conventional processes may be applied to the second slurry before placement thereof for removing or at least reducing fine bubbles in the second slurry other than the process above-mentioned:

(1) The slurry is pressurized to dissolve the bubbles into it, (2) The slurry is heated to remove them, and (3) The slurry is placed under reduced pressure to remove them.

Instead of two continuous mixers such as screw mixers 12 and 30, a single batch mixer such as tilting drum mixer and pan type mixer may be used, in which case water is added to fly ash for two times as in the preceding embodiment although it may be added at a time.

Figure 5:
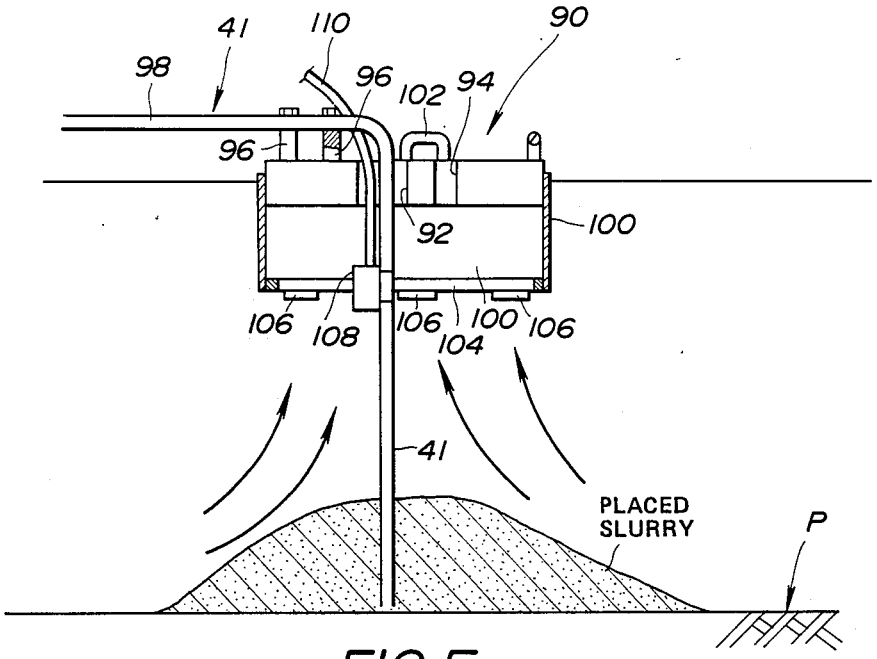
FIG. 5 is a vertical section of a slurry placing, floating platform used in practicing the present invention.
Figure 6:
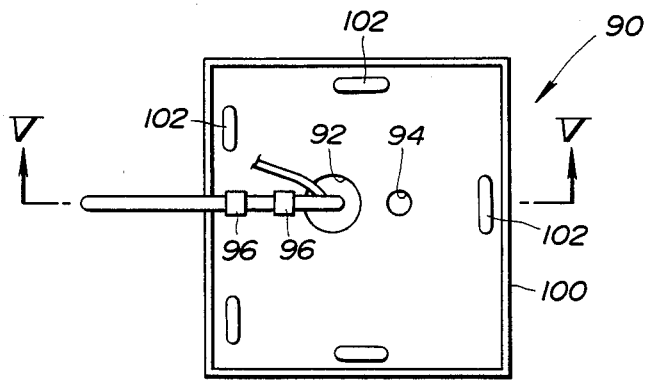
FIG. 6 is a plan view of the floating platform in FIG. 5.

FIGS. 5 and 6 illustrates a floating platform 90 for use in placing the second slurry from the pump 39 in sea or lakes. The floating platform 90 is in the shape of a flat rectilinear box made of steel and is applied at its outer faces with a conventional corrosive resistant paint. The platform 90 has at its center portion two vertical through holes 92 and 94, one through hole 92 being larger in diameter than the other 94. The placing pipe 41 horizontally extends and its one end is connected via a flexible pipe and a transport pipe (both pipes not shown) to the pump 39. The other end portion of the placing pipe 41 is vertically downwards bent at its portion just above the larger diameter hole 92 to pass through it. A pair of supporting members 96 and 96 are erected on the platform 90 and the horizontal portion 98 of the placing pipe 41 passes through the supporting members 96 and 96. The smaller diameter hole 94 is used to manually remove suspended solids, mainly cenosphere, on and in the water through it. The platform 90 is provided on its peripheral edges with a fence 100 having a skirt shape to depend from it and has five eye members 102 mounted on its upper face for tying an anchoring rope or a rope for towing it. The fence 100 may be made of a cloth, synthetic fiber sheet, fine net, etc providing it is capable of collecting the suspended solids and of allowing water to pass through it. The fence 100 has a reinforcement member 104 secured at the inner face of its lower edge, the reinforcement member 104 having a square ring shape. The reinforcement member 104 has many anchors 106 attached to it for preventing the fence 100 from being deformed due to a water current and waves. The level of the lower end of the fence 100 is adjusted by ropes, not shown, connecting the reinforcement member 104 with the eye members 102. The placing pipe 41 has a submergible motor pump 108 at a level of the lower end of the fence 100. The pump 108 has a discharge pipe 110 upwardly extending from it through the larger diameter hole 92 to shore. When a water current exists, it is preferable to position the pump 108 to the downstream side of the placing pipe 41 by adjusting the position of the floating platform 90 for efficiently collect suspended solids in water.

In placing the slurry underwater, the length or depth of the fence 100 is adjusted according to the depth of the placement site P and flow velocity of the current. When fine bubbles are projected from the sedimented slurry S, substances such as, unburnt carbon, fine particles, etc are ejected into water as suspended solids, which may cause environmental pollution. A larger proportion of the suspended solids are collected together with water and is pumped by the pump 108 through the discharge pipe 110 to shore, where it is supplied to the water tank 22. The suspended solids within the fence 100 may be manually collected with a bucket through the smaller diameter hole 94. In our experiments using a test tank in which a 2.4 cm diameter placing pipe was used without providing the floating platform 90 and submergible pump 108, it was noted that when flow velocity of water at the placement site was zero, more than about 60% of suspended solids produced due to bubbles in the sedimented slurry are collected within a circle having a diameter about 10 times as large as the diameter of the placing pipe. Thus, it is presumed that provision of the fence having such a diameter can considerably prevent environmental pollution due to the suspended solids.

EXAMPLES 1–3

A coal ash slurry was prepared in compositions shown in Table below by the apparatus illustrated in FIGS. 1 to 3 for each of Examples 1–3, but instead of the first and second mixers 12 and 30 a single power driven blade mixer was used. The physical properties of coal ashes used were indicated in the Table. In each example water was added for two times as illustrated in connection with the embodiment. Each slurry thus prepared was deaerated in the deaerator 38 having 2.8 cm diameter vibration rods 48 where the deaerator was operated during slurry placing. The frequency and amplitude of vibration applied to the slurry were 240 Hz and 1 mm, respectively. Each slurry thus deaerated was placed in a 0.28 $m^3$ water tank containing 30 cm deep water or a 7.0 $m^3$ water tank containing 100 cm deep water and the amount of cenosphere floated onto the water surface was determined. The results are given in the Table in weight percent over the amount of the cenosphere in the placed fly ash.

Comparative Test

A slurry was prepared in the same manner as in the preceding Examples 1–3 excet that any deaerator was not used and the amount of cenosphere floated onto the water surface in the 0.23 $m^3$ test tank containing 30 cm deep water was determined in the same manner as in the Examples 1–3. The results are also given in the Table in weight percent over the amount of cenosphere in the placed fly ash. Fly ashes used in Example 3 and the Comparative test were slightly different in physical properties and cenosphere content but it is believed that these differences would not produce any substantial influence on the results.

TABLE

| | Example | | | Comparative |
|---|---|---|---|---|
| | 1 | 2 | 3 | Test |
| Fly ash | | | | |
| Specific gravity ($g/cm^3$) | 2.23 | 2.29 | 2.35 | 2.20 |
| Optimum water content (%) | 25.8 | 27.5 | 19.0 | 20.3 |
| Cenosphere content (wt. %) | 0.25 | 0.22 | 0.43 | 0.54 |
| Slurry components (weight part) | | | | |
| Fly ash | 100 | 100 | 100 | 100 |
| Water: first time | 40 | 26 | 23.3 | 23.3 |
| second time | 20 | 13 | 11.7 | 11.7 |
| Cenosphere in placed fly ash (g) | 241 | 220 | $11.2 \times 10^3$ | 255 |
| Test tank size ($m^3$) | 0.28 | 0.28 | 7.0 | 0.28 |
| Cenosphere floated onto water surface (g) | 0.0332 | 0.1217 | 1.3649 | 1.4774 |
| Concentration of cenosphere floated (%) | 0.014 | 0.055 | 0.012 | 0.58 |

What is claimed is:

1. In a method for producing a fly ash slurry for underwater placement, comprising the steps of:

preparing the slurry in a mixing means;

agitating the slurry, said agitating step producing a multitude of bubbles in the slurry;

depositing the slurry in an underwater site; and reducing the number of bubbles in the slurry after the agitating step and prior to the depositing step; wherein the slurry includes solid particles that become suspended in water adjacent the underwater site, and the preparing step includes the step of mixing the fly ash with water to produce the fly ash slurry, the mixing step including the steps of (i) collecting water adjacent the underwater site to collect suspended solid particles from the slurry, and (ii) mixing the collected water, including the solid particles suspended therein, with the fly ash to produce the fly ash slurry.

2. A method according to claim 1, wherein the reducing step includes the step of mechanically vibrating the fly ash slurry to reduce the number of the bubbles therein.

3. A method according to claim 2, wherein the step of mixing the fly ash with water includes the steps of:

mixing fly ash with water, within a range of about 10% of an optimum water content, in a first continuous mixer, to produce a first fly ash slurry; and mixing the first fly ash slurry with additional water, at a water content of about 5 to 25% by weight, in a second continuous mixer, to produce a second fly ash slurry.

4. A method according to claim 3, wherein the preparing step further includes the step of discharging at least a part of the first fly ash slurry from the first continuous mixer for supplying a land use thereof.

5. A method according to claim 1, wherein: the depositing step includes the steps of (i) locating a floating platform adjacent the underwater site, (ii) passing a placement pipe through the floating platform, wherein the placement pipe includes an underwater portion, and (iii) conducting the slurry through the placement pipe and through the floating platform, to the underwater site; and the collecting step includes the steps of (i) connecting a fence to the platform, and extending the fence around the underwater portion of the placement pipe, (ii) locating a pump underwater, within the fence, and (iii) actuating the pump to collect water from within the fence, and to collect suspended solid particles from within the fence.

6. Apparatus for producing a slurry comprising:

supplying means for supplying hydraulic setting material and water in a predetermined ratio;

mixing means connected to the supplying means to receive the setting material and the water therefrom, and to mix the setting material with the water to produce the slurry;

underwater placement means to conduct the slurry to, and to deposit the slurry in, an underwater site; and conducting means connected to the mixing means and to underwater placement means, to conduct the slurry from the mixing means to the underwater means, the conducting means including (i) agitating means to mix and agitate the slurry, said mixing and agitating producing bubbles in the slurry, and (ii) deaerating means located in series between the agitating means and the underwater placement means, to reduce the number of bubbles in the slurry prior to the slurry being conducted to the underwater site;

wherein the deareating means comprises (i) a funnel-shaped tank for receiving the slurry from the agitating means, the tank defining a generally vertical central axis, and including (1) an inlet to conduct the slurry into the tank, (2) an outlet to discharge the slurry from the tank, and (3) a downwardly inwardly tapering funnel portion extending between the inlet and outlet of the tank to conduct the slurry from said inlet to said outlet, (ii) a plurality of vibrating means mounted on the tank at equal angular intervals about the central axis thereof, to vibrate the slurry in the tank, the vibrating means including (1) a plurality of vibrating rods extending downwardly inwardly into the tank, at equal angular intervals about the central axis thereof, (2) a plurality of branches connected to and extending upward and downward from the vibrating rods, and (3) a plurality of vibrators, each vibrator being connected to a respective one of the vibrating rods to vibrate said one rod, (iii) a plurality of support legs supporting the vibrating rods for reciprocating sliding movement in the tank, and (iv) a plurality of vibrating rings mounted on the vibrating rods concentric with the axis of the tank, each of the vibrating rods being connected to each of the vibrating rings, the plurality of vibrating rings including (1) an upper set of rings connected to said branches, above the vibrating rods, and (2) a lower set of rings connected to said branches, below the vibrating rods.

7. Apparatus according to claim 6, wherein:

the supplying means includes first and second water supplies;

the mixing means includes (i) a first continuous mixer for mixing the setting material with water from the first water supply to produce a first slurry, (ii) a second continuous mixer for mixing the first slurry with water from the second water supply to produce a second slurry, (iii) means to conduct the first slurry from the first continuous mixer to the second continuous mixer; and the conducting means includes means to conduct the second slurry to the agitating means from the second continuous mixer.

8. Apparatus according to claim 7, wherein:

the means to conduct the first slurry from the first continuous mixer to the second continuous mixer includes (i) conduit means connected to the first and second continuous mixers to conduct the first slurry from the first mixer to the second mixer, (ii) a transport line connected to the conduit means to conduct the first slurry away from the mixing means for use on land and (iii) a control valve located in the conduit means and having first and second positions;

in the first position, the control valve directs the first slurry from the first mixer, through the conduit means, and into the second mixer; and in the second position, the control valve directs the first slurry from the first mixer and into the transport line for use on land.

9. Apparatus for producing a slurry comprising:

supplying means for supplying hydraulic setting material and water in a predetermined ratio;

mixing means connected to the supplying means to receive the setting material and the water therefrom, and to mix the setting material with the water to produce the slurry;

underwater placement means to conduct the slurry to, and to deposit the slurry in, an underwater site; and conducting means connected to the mixing means and to the underwater placement means, to conduct the slurry from the mixing means to the underwater placement means, the conducting means including (i) agitating means to mix and agitate the slurry, said mixing and agitating producing bubbles in the slurry, and (ii) deareating means located in series between the agitating means and the underwater placement means, to reduce the number of bubbles in the slurry prior to the slurry being conducted to the underwater site;

wherein the underwater placement means includes:

(i) a floating platform adjacent the placement site;

(ii) a placement pipe extending through the floating platform, to conduct the slurry through said platform and to the underwater placement site, the placement pipe including a portion located underwater;

(iii) a fence connected to the platform, extending around the underwater portion of the placement pipe, and bounding an area under the platform;

(iv) a pump supported by the platform and located underwater, within the area bounded by the fence, to collect water and suspended solid particles from the slurry, from within said area; and (v) conducting means connected to the pump and to the supplying means to conduct the collected water and suspended solid particles to the supplying means from the pump, to recirculate the suspended solid particles back into the slurry.

* * * * *

UNITED STATES PATENT AND TRADEMARK OFFICE

CERTIFICATE OF CORRECTION

PATENT NO. : 4,759,632

DATED : July 26, 1988

INVENTOR(S) : Sumio Horiuchi, et al.

It is certified that error appears in the above-identified patent and that said Letters Patent is hereby corrected as shown below:

Column 6, line 35: "excet" should read as --except--

Column 8, lines 1-2, Claim 6: "underwater means' should read as --underwater placement means--

Signed and Sealed this

Twenty-fourth Day of October, 1989

*Attest:*

DONALD J. QUIGG

*Attesting Officer*

*Commissioner of Patents and Trademarks*